United States Patent [19]

Wasserman

[11] 3,955,870

[45] May 11, 1976

[54] UTILITY OUTLET GUARD

[75] Inventor: Saul Z. Wasserman, Brooklyn, N.Y.

[73] Assignee: Lawrence Peska Associates, Inc., New York, N.Y. ; a part interest

[22] Filed: Aug. 21, 1975

[21] Appl. No.: 606,552

[52] U.S. Cl. ..... 339/39; 339/75 P

[51] Int. Cl.[2] ..... H01R 13/44

[58] Field of Search ..... 339/36, 39, 75–79, 339/82, 91

[56] References Cited

UNITED STATES PATENTS

| | | | |
|---|---|---|---|
| 2,266,560 | 12/1941 | Mansfield | 339/77 |
| 2,462,756 | 2/1949 | Leopold | 339/36 |
| 2,569,037 | 9/1951 | Dalton | 339/75 P |
| 2,716,225 | 8/1955 | McCubbin | 339/77 X |
| 2,818,991 | 1/1958 | Hess | 339/39 X |
| 3,428,936 | 2/1969 | Arnao | 339/39 |
| 3,601,757 | 8/1971 | Gober | 339/39 |

*Primary Examiner*—Joseph H. McGlynn
*Assistant Examiner*—Craig R. Feinberg

[57] ABSTRACT

This disclosure pertains to an apparatus facilitating convenient insertion and removal of electrical plugs into household utility outlets while providing a generally semi-hemispheric hollow dome shaped enclosure protecting the blades of a partially inserted plug from accidental contact by children or pets. The stationary portion of the shielding apparatus is comprised of slightly more than one half of a semi-hemisphere which is fastened permanently to the cover plate of the utility outlet. The remaining portion of the semi-hemisphere is comprised of two half semi-hemispheres each spring loaded to close against each other. When closed, the two movable half semi-hemispherical surfaces, combined with the stationary portion of the semi-hemisphere, create an enclosure generally semi-hemispheric in shape which totally encloses a portion of the line cord fastened to the plug, the plug, and the surface of the utility outlet receptacle. The axis of rotation of each half semi-hemisphere is normal to the plane of the utility outlet's face plate and coincident with the center of the outlet receptacle. A tab is fastened to each movable half semi-hemispheric surface adjacent the edges that contact each other which provides a convenient method for opening the half semi-hemispheres, enabling access to the plug whilst permitting the line cord adjacent the plug to be removed from the enclosure. Semi-hemispheric guard assemblies may be fastened to the cover plate providing protection for one or both convenience outlets in a duplex outlet receptacle. Mounting of the guard assembly to the face plate is accomplished to either the center face plate fastening screw or by utilizing a contact adhesive along the surface of the stationary portion of the semi-hemisphere engaging the surface of the face plate.

8 Claims, 3 Drawing Figures

UTILITY OUTLET GUARD

BACKGROUND OF THE INVENTION

1. The Field of the Invention

This invention relates to electrical protective safety devices in general and more particularly, that class that pertains to eliminating accidental contact between children or pets and exposed electrical elements of a plug partially inserted in a household convenience outlet.

2. Description of the Prior Art

The prior art abounds with a variety of flexible and rigid enclosures for convenience outlets and plugs including slidable surfaces, knotches in stationary enclosures, and hinged access panels, all of which provide protection for both outlets of a duplex outlet receptacle.

SUMMARY OF THE INVENTION

A shielding enclosure for a conventional household plug and a portion of the line cable to which it is affixed, is comprised of a generally hollow semi-hemispheric surface fastened to the cover plate to which the outlet receptacle relates. Two half quadrants of the semi-hemisphere rotate about an axis coincident with the central longitudinal axis of the line cord, plug, and receptacle, to an open position, enabling the user to engage or disengage the plug and receptacle and provide for insertion and removal of the captured portion of the line cord. Two tabs are provided to open the movable half semi-hemispheric surfaces which are biased to close by independent spring means. A knotch is provided in the slightly larger stationary half semi-hemisphere permitting the line cord to enter the confines of the enclosure.

A primary object of the instant invention is to provide an inexpensive electrical safety device for a unitary outlet receptacle.

Another object is to provide an enclosure which may be conveniently opened and closed by adults while interposing substantial difficulty, if not impossibility for accidental contact of energized electrical elements within the enclosure by children, pets, or metallic objects.

Still another object is to provide a safety enclosure which is easily fastened to conventional popular utility outlet covers.

A further object is to provide a safety enclosure design which enables either or both outlet receptacles of a duplex outlet receptacle to be protected.

Another object is to provide a safety enclosure which facilitates secure engagement of an enclosed plug into the surrounded receptacle.

Still another object is to provide a generally pleasant appearing structure comprised of either opaque or transparent material.

These objects, as well as other objects, of this invention will become readily apparent after reading the following description of the accompanying drawings.

DESCRIPTION OF THE PREFERRED EMBODIMENT

Figure 1:
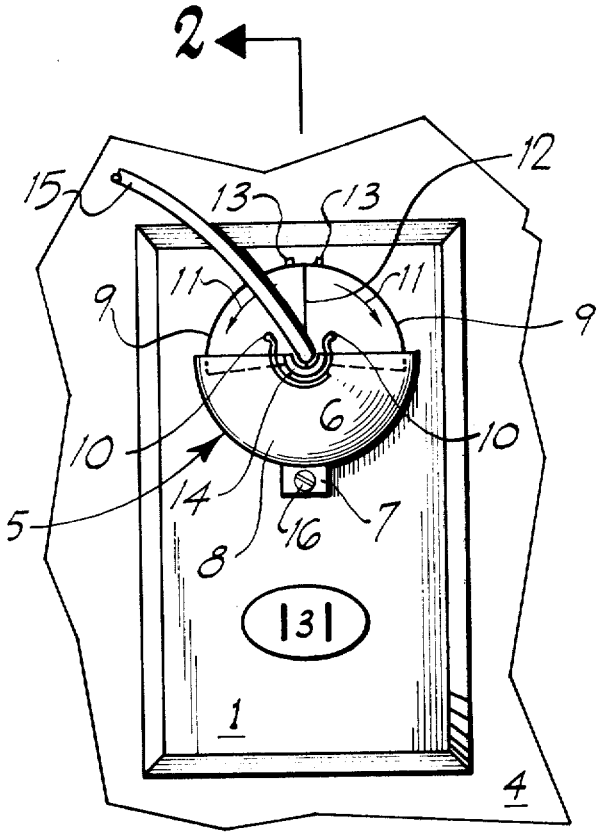
FIG. 1 is a front elevation view of a safety enclosure installed on the face plate of a duplex utility outlet.

The structure and method of fabrication of the present invention is applicable to a safety enclosure comprised of a stationary hollow housing formed in the shape of approximately one quarter of a hollow sphere adapted with a partial lateral mounting surface lying in the plane of the edge which lies in a plane passing through the origin of the sphere. The mounting surface extends radially beyond the outermost surface of the sphere and is adapted to be fastened to the cover plate of a duplex utility outlet by utilizing the cover plate mounting machine screw. A hole in the mounting surface is positioned to permit the surface normal to the plane of the cover plate to lie in a plane displaced slightly away from the center of the receptacle in a direction farthest from the mounting screw. A slot is formed at the apex of the stationary partial dome which permits an appliance line cord to be totally captured within the confines of the open ended slot. Two symmetrical surfaces, when combined, form the other half of the semi-hemisphere having an outside diameter somewhat smaller than the inside diameter of the stationary enclosure, and they are fastened to the stationary enclosure by two semi-circular springs serving as access panels. The access panels and the stationary portion of the semi-sphere may be fabricated from a metallic material or of rigid plastic that can be transparent, if desired. One end of each spring fastens to an access panel while the other free ends fasten to the stationary housing, providing bias forces to each access panel, tending to maintain them in contact along a plane normal to the cover plate passing through the center of the utility outlet receptacle and the mounting screw. A tab protrudes radially outwardly from each access panel and is fastened adjacent the surfaces that meet when the access panels are in touching engagement. In use, the access panels are rotated in opposite directions about the line normal to the cover plate located in the center of the utility outlet such that both access panels nest virtually totally within the confines of the stationary housing parallel to the inner surface of the stationary housing. The plug of an electrical appliance is inserted into the utility outlet and the line cord is inserted into the slot permitting it to protrude beyond the uppermost outermost surface of the stationary housing. The access panels are allowed to close capturing the line cord in the slot. The access panels, when closed, exert forces on the line cord tangential to the surface of the sphere tending to firmly clamp the line cord to the walls of the slot in the stationary housing. Accidental dislodging of the plug from its inserted position in the utility outlet is thereby prevented.

Two safety enclosures may be successfully mounted onto the surface of a cover plate utilizing a single cover plate mounting screw. Should the cover plate have the design which employs two mounting screws, the external mounting tab is employed to fasten a safety enclosure to one of the mounting screws. In similar fashion, two safety enclosures may be simultaneously utilized on one duplex utility outlet, each safety enclosure being fastened to one of the two cover plate mounting screws.

DESCRIPTION OF ALTERNATIVE EMBODIMENTS

An alternative embodiment may be particularized by having an additional internal lateral mounting surface whose lowermost surface lies in a plane that passes through the origin of the sphere having a free edge parallel to the plane formed by the edges of the stationary enclosure that is normal to the cover plate. This additional mounting surface has its free edge along a chord length parallel to the vertical edges of the stationary housing. The undermost face of the additional mounting surface may be provided with a pressure sensitive contact adhesive covered with a paperlike material serving as protection for the adhesive layer. Installation of the entire assembly is accomplished by removal of the paper protective barrier, which exposes the pressure sensitive adhesive. The additional mounting surface is placed in intimate parallel contacting engagement with the cover plate as the assembly is centered about one utility outlet. The external tab aforementioned may be broken off if desired, or alternatively, adapted with adhesive on its lowermost cover plate contacting surface. To insure greater security in fastening to the cover plate, the edge of the stationary housing which touches the cover plate other than the additional mounting surface, may be similarly coated with pressure sensitive adhesive and protected with the paper-like barrier material.

Now referring to the Figures, and more particularly to the embodiment illustrated in FIG. 1 showing a cover plate 1 through which a utility outlet 3 is exposed. The face plate is usually positioned near the lower edges of a wall 4. The safety enclosure 5 comprises a hollow section of one quarter of a sphere 6, the lowermost edges of which are parallel to the cover plate 1 and lie in a plane containing an external mounting tab 7 and an internal mounting surface 8. Two access surfaces 9 each being the equivalent of one half of a quarter sphere have outside diameters smaller than the inside diameter of the quarter sphere 6. They are fastened to the quarter sphere 6 through the use of semi-circular springs 10, maintaining them in a biasing position opposite to the arrows 11, such that one of their vertical surfaces meet at line 12 when closed. Two small axially projecting tabs 13 are fastened adjacent the line 12 such that either or both of the half quarter spherical surfaces 9 can be operated in the direction the arrows 11 permitting the half quarter spherical surfaces to virtually fully nest within the inner confines of the stationary quarter sphere 6. Slot 14 is provided at the apex of quarter sphere 6 providing a passageway for a line cord 15 from the interior confines of the closed semi-sphere to the external electrical appliance, not shown. The closed semisphere comprised of the stationary quarter spherical surface 6 and the two closed half quarter spherical surfaces 9, successfully clamp the line cord 15 such that the line cord, upon being pulled, is incapable of exerting a force on the portion of the line cord confined within the enclosure. Corners of the access quarter semi-spheres 9 apply a force on the line cord 15 in the general direction of the exposed utility outlet 3. Mounting tab 7 is adapted with a hole utilized by the cover plate's mounting machine screw 16 to fasten the safety enclosure securely to the exposed surface of the cover plate.

Figure 2:
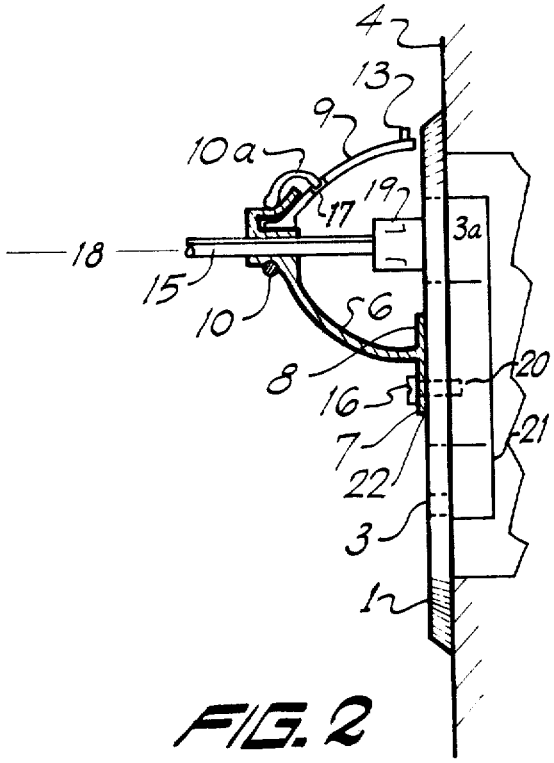
FIG. 2 is a partial cross-sectional side elevation view taken along line 2—2 viewed in the direction of arrows 2—2 as illustrated in FIG. 1.

FIG. 2 is a side elevation view of the cross-section taken along line 2—2 viewed in the direction of arrows 2—2, as shown in FIG. 1. Spring 10 has one free end securely fastened to the stationary portion of the enclosure 6. The other end of the spring 10*a* is bent so that it passes through a small hole 17 within the surface of the access panel 9. The surface of the edge of access panel 9 does not contact the outermost surface of the cover plate 1, permitting rotation of the access panel 9 about a line 18 which corresponds with the center of the plug 19 inserted in utility outlet 3*a*. Machine screw 16 passes through tab 7 and fastens to a ferrule 20 located in the center of the duplex outlet receptacle 21. The contacting surface of the mounting tab 7 and the internal chordal plane 8, which is in engagement with the outermost surface of cover plate 1, may be provided with an adhesive layer 22. This layer is protected by an outermost paper-like barrier, not shown, during storage or shipment of the enclosure, which is removed such that the pressure sensitive adhesive layer 22 may be utilized to securely fasten the safety enclosure to the surface of the cover plate 1. Tab 7 may be broken away from the stationary portion 6 of the safety enclosure, if so desired, relying on the outermost surface of the chordal mounting segment 8 for fastening to the cover plate 1, solely utilizing the adhesive layer 22 for mounting purposes.

Figure 3:
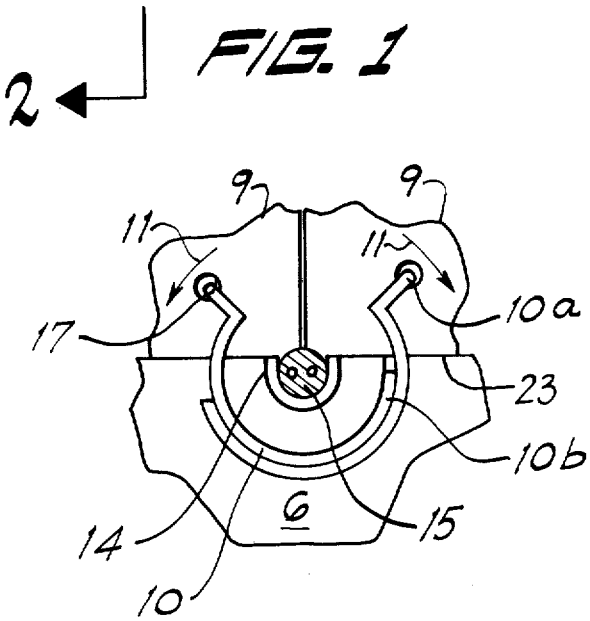
FIG. 3 is a partial elevation view of the apex of the safety enclosure.

FIG. 3 is a partial plan view of the apex of the safety enclosure illustrating the stationary hollow quarter sphere 6 and the two access panels 9 operable in the direction of arrows 11. Spring 10 has one of its free ends 10*a* passing through a hole 17 in the access panel 9. The end 10*b* of spring 10 is fastened to the hollow stationary quarter spherical surface 6 and does not project beyond the line 23, thus permitting the insertion of line cord 15 into slot 14.

One of the advantages is an inexpensive electrical safety device for a unitary outlet receptacle.

A further advantage is an enclosure which may be conveniently opened and closed by adults while interposing substantial difficulty, if not impossibility for accidental contact of energized electrical elements within the enclosure by children, pets, or metallic objects.

Another advantage is a safety enclosure which is easily fastened to conventional popular utility outlet receptacles.

Still another advantage is a safety enclosure design which enables either or both outlet receptacles of a duplex outlet receptacle to be protected.

A further advantage is a safety enclosure which facilitates secure engagement of an enclosed plug into the surrounded receptacle.

Another advantage is a generally pleasant appearing structure comprised of either opaque or transparent material.

Thus, there is disclosed in the above description and in the drawings, embodiments of the invention which fully and effectively accomplish the objects thereof. However, it will be apparent, to those skilled in the art, how to make variations and modifications to the instant invention. Therefore, this invention is to be limited not by the specific disclosure herein, but only by the appending claims.

The embodiments of the invention in which an exclusive privilege or property is claimed are defined as follows:

1. A safety enclosure comprising a hollow semisphere having a lateral chordal fastening surface affixed parallel and adjacent to a free edge thereof, said lateral chordal surface being fastened to a cover plate of an electrical utility outlet, said semi-sphere in combination with two access panels each having biasing means tending to force said panels into closed position providing minimal access to the interior of said hollow semi-sphere, said access panels having surfaces which rotate about a line into an open position confining said access panels within a portion of said hollow semi-sphere which is stationary and affixed to said cover plate when manual opposing forces in opposition to the force established by said biasing means are exerted upon said access panels, said line normal to a first plane formed by the exterior lateral surface of said cover plate passing through the center of said utility outlet and through the apex of said hollow semi-sphere, said access panels adapted to engage each other having their engaging edges lying in a second plane normal to said first plane, said line lying in said second plane, an open ended slot formed in the portion of said semi-sphere which is fastened to said cover plate, said slot centered about said line, said access panels having parallel edges to said first plane, said parallel edges free of touching engagement with said first plane.

2. The safety enclosure of claim 1 further comprising an external lateral tab projecting radially outwardly from said fastened portion of said semi-sphere, said tab having a fastening surface coextensive with said laterial surface, a hole formed through said external lateral tab adapted to accept a fastening screw for said cover plate.

3. The safety enclosure of claim 2 further comprising a pressure sensitive adhesive layer on said coextensive surface of said tab and on said chordal fastening surface formed within said fastened portion of said semisphere lying in said first plane, said adhesive layer adapted for fastening said fastened portion of said semisphere and said tab to the surface of said cover plate.

4. The safety enclosure of claim 1 further comprising manipulative tabs extending radially outwardly on each of said access panels adjacent the edge that lies in said second plane when said access panels are in said closed position.

5. The safety enclosure of claim 3 further comprising an additional pressure sensitive adhesive layer on the remaining portions of the edges lying in said first plane coextensive with and otherwise adapted with said adhesive layer on said fastening chordal surface and said external lateral tab of said semi-sphere, said additional layer of adhesive and said adhesive layer fastened to said external tab and said adhesive layer fastened to said fastening surface lying in said first plane.

6. The safety enclosure of claim 1 wherein said biasing means comprises two semi-circular springs, one end of one of said springs fastened to said stationary portion of said semi-sphere, the other end of said spring adapted to fasten to one of said access panels, one end of the other spring fastened to said stationary portion of said semi-sphere, the other end of said other spring adapted to fasten to the other said access panel.

7. The safety enclosure of claim 1 further comprising means to securely clampingly engage a portion of the line chord of an electrical appliance, said portion securely clamped by said slot when said access panels are in said closed position, said line cord having a confined portion within said safety enclosure adapted with an electrical utility plug at the end thereof, said plug confined within said enclosure, means to electrically engage and disengage said plug with said utility outlet receptacle, means to remove said plug and said confined portion of said line cord and said clamped portion of said line cord from said confinement within said safety enclosure.

8. The safety enclosure of claim 1 wherein said semi-spherical enclosure is transparent.

* * * * *